United States Patent [19]

Furuya et al.

[11] Patent Number: 4,971,187

[45] Date of Patent: Nov. 20, 1990

[54] METHOD AND APPARATUS FOR SORTING COINS UTILIZING COIN-DERIVED SIGNALS CONTAINING DIFFERENT HARMONIC COMPONENTS

[75] Inventors: Yonezo Furuya, Hatoyama; Takeshi Ishida, Sakado; Ichiro Fukuda, Kawagoe; Genzo Yoshizawa, Iwabuchi, all of Japan

[73] Assignee: Nippon Conlux Co., Ltd., Tokyo, Japan

[21] Appl. No.: 290,473

[22] Filed: Dec. 29, 1988

[30] Foreign Application Priority Data

Mar. 31, 1988 [JP] Japan ..... 63-79531

[51] Int. Cl.[5] ..... G07D 5/08

[52] U.S. Cl. ..... 194/318; 194/302; 324/236

[58] Field of Search ..... 194/317, 318, 319, 302; 324/236, 239, 262

[56] References Cited

U.S. PATENT DOCUMENTS

| | | | |
|---|---|---|---|
| 3,059,749 | 10/1962 | Zinke | 194/319 X |
| 3,506,103 | 4/1970 | Kuckens et al. | 194/318 |
| 3,869,663 | 3/1975 | Tschierse | 194/318 X |
| 3,918,563 | 11/1975 | Schwippert et al. | 194/318 |
| 4,091,908 | 5/1978 | Hayashi et al. | 194/318 |
| 4,538,719 | 9/1985 | Gray et al. | 324/236 X |
| 4,717,006 | 1/1988 | Chapman et al. | 194/318 |
| 4,901,017 | 2/1990 | Zinke | 324/239 X |

*Primary Examiner*—Joseph J. Rolla
*Assistant Examiner*—T. Nguyen
*Attorney, Agent, or Firm*—Diller, Ramik & Wight

[57] ABSTRACT

A coin to be judged is passed near an oscillation coil excited by an exciting signal containing a plurality of harmonic components, that is nonsinusoidal alternating current, and the coin is sorted in accordance with a signal produced by a receiving coil electromagnetically coupled with the oscillation coil and containing at least two harmonic components. The signal induced in the receiving coil may be a composite signal of at least two harmonic components. This signal may consist of a first signal of a composite of at least two harmonic components and a second signal of a composite of at least two other harmonic components.

12 Claims, 15 Drawing Sheets

METHOD AND APPARATUS FOR SORTING COINS UTILIZING COIN-DERIVED SIGNALS CONTAINING DIFFERENT HARMONIC COMPONENTS

BACKGROUND OF THE INVENTION

1. Field of the Invention

This invention relates to a method and apparatus for sorting coins utilized in automatic vending machines, money exchange machines; service devices, etc., and more particularly to an electronic coin sorting apparatus which sorts coins by electronic means.

2. Description of the Related Art

There have been used two types of coin sorting apparatus. The first type is mechanical sorting apparatus in which the characteristics of coins are mechanically examined or judged for sorting, and the other type is electrical sorting apparatus in which the characteristics of the coins are detected by electronic means and the coins are sorted according to the detected outputs. Since the electronic coin sorting apparatus has a high sorting accuracy and can be miniaturized, this type of the sorting apparatus have been used widely.

An electronic coin sorting apparatus is generally constructed such that a primary coil excited by a signal of a definite frequency is disposed on one side of a coin passage, a secondary coil electromagnetically coupled with the primary coil is disposed on the other side of the coin passage, an attenuating voltage signal generated by the secondary coil which is generated at the time of passing the coin is used to judge whether the coin is genuine or counterfeit, and the reliability of the coin is examined according to a result of judgment.

An electronic coin sorting apparatus has also been proposed wherein a plurality of pairs of coin detecting coils each comprising a primary oscillation coil and a secondary receiving coil are provided for detecting the material, thickness, external diameter or the like of the coin. Further, according to one method, signals of different frequencies are applied to different primary coils while in another method the primary coil itself acts as an element of an oscillation circuit so as to constitute a self-oscillation circuit. In both methods a plurality of discrete driving circuits or oscillation circuits are provided for exciting respective primary coils.

U.S. Pat. No. 3870137 discloses a coin sorting apparatus wherein at least two electromagnetic fields having different frequencies are provided for judging the characteristics of the coin by the action of these electromagnetic fields. Respective electromagnetic fields have different oscillation circuits to be applied with different check frequencies so as to check whether the diameter and thickness of the coin are included in predetermined ranges by using the interaction between the coin and the different check frequencies. When the coin satisfies the check standard of at least two different frequencies, the coin is judged acceptable.

With the prior art, however, to improve the coin sorting accuracy, it is necessary to use a plurality of oscillation circuits and oscillation coils, so that the number of component parts and hence the manufacturing cost are increased. Moreover, since respective oscillation coils are excited by different frequencies, interference between these coils is liable to occur. To avoid the interference, it is necessary to increase the distance between the coils which lengthens the coin passage.

In the prior art coin sorting apparatus, for example, that described in U.S. Pat. No. 3870137, for the purpose of providing interaction with the coin, a plurality of exciting coils respectively excited by low and high frequencies are used. Consequently where clad coins are to be examined wherein the sheets of nickel and copper are superposed as in 10 cent, 25 cent and 50 cent coins, for the purpose of checking characteristics of respective materials, it is necessary to use a plurality of oscillation circuits and oscillation coils. As a consequence, the sorting circuit also become complicated. Furthermore, for the purpose of judging the material and thickness of the coin, an independent low frequency oscillation circuit and a high frequency oscillation circuit are necessary for obtaining discrete mutual reactions so that the judging means becomes complicated in construction. Moreover, such judging means can be used for only a specific type of coins.

SUMMARY OF THE INVENTION

Accordingly, it is an object of this invention to provide a novel method of sorting coins, and a coin sorting apparatus having a small size, and inexpensive simple construction.

According to one aspect of this invention, there is provided a method of sorting coins comprising the steps of passing coins to be sorted near a primary or oscillation coil excited by an exciting signal containing a of harmonic and sorting the coins in accordance with a received signal induced in a receiving coil electromagnetically coupled with the oscillation coil, the received signal containing at least two harmonic components.

The exciting signal may be a rectangular wave or a nonsinusoidal wave. A resonance circuit or a bandpass filter selectively passing a signal in a specific frequency bandwidth may be provided. A judging circuit may be connected to the receiving coil for judging whether the coin is genuine or counterfeit, and the type of coins and the material, the configuration and the outer diameter of the coin. The coin is sorted by the output of the judging circuit.

In accordance with another aspect of this invention, there is provided a coin sorting apparatus comprising an oscillation coil excited by an exciting signal containing a of harmonic, a receiving coil electromagnetically coupled with the oscillation coil, a coin passage for passing the coin near the oscillation coil, means for extracting a composite signal based on at least two harmonic components from a received signal induced in the receiving coil as a result of passing the coin through the coin passage, and means for sorting the coin based on the composite signal extracted by the extracting means.

The exciting signal may be a signal having a rectangular wave form. The oscillation coil may be a single coil and one or two receiving coils may be electromagnetically coupled therewith. Alternatively two oscillation coils are connected in series and two receiving coils coupled with two oscillation coils respectively can be used.

BRIEF DESCRIPTIONS OF THE DRAWINGS

DESCRIPTION OF THE PREFERRED EMBODIMENTS

Figure 1:
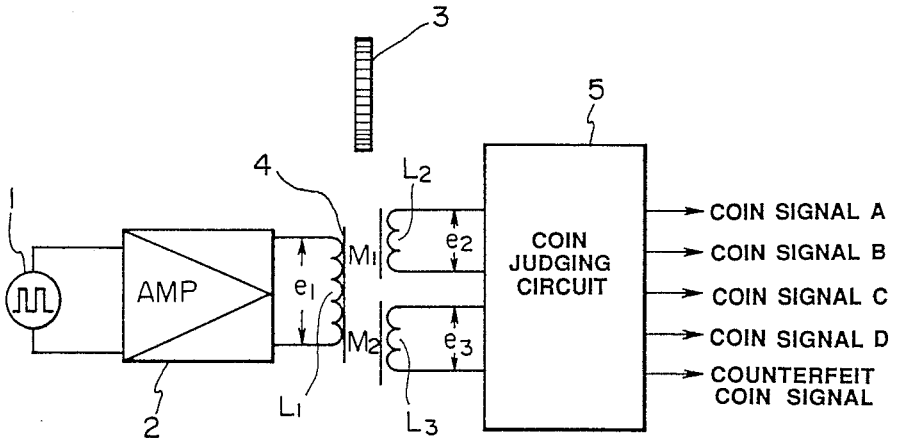
FIG. 1 is a block diagram showing one embodiment of this invention.

An embodiment of this invention shown in FIG. 1 comprises a rectangular wave oscillation circuit 1, a primary or oscillation coil $L_1$ and two receiving or secondary coils $L_2$ and $L_3$.

The output of the rectangular wave oscillation circuit 1 is applied to the oscillation coil $L_1$ through an amplifier 2. The oscillation coil $L_1$ is disposed on one side of a coin passage 4 while receiving coils $L_2$ and $L_3$ are disposed on the other side to oppose the oscillation coil $L_1$.

The oscillation coil $L_1$ is excited by a rectangular wave signal outputted by the rectangular wave oscillation circuit 1 to vary the mutual inductance $M_1$ between the oscillation coil $L_1$ and the receiving coil $L_2$ and the mutual inductance $M_2$ between the oscillation coil $L_1$ and the receiving coil $L_3$ caused by the passage of a coin 3 to be judged through the coin passage 4, so that signals for judging whether the coin is genuine or counterfeit are induced in the receiving coils $L_2$ and $L_3$.

The outputs of the receiving coils $L_2$ and $L_3$ are applied to a coin judging circuit 5 which in response to the outputs of the receiving coils $L_2$ and $L_3$ judges whether the coin 3 is genuine or counterfeit as well as the type of the coin 3. Thus, when the coin 3 is genuine the coin judging circuit 5 produces coin signals A, B, C or D representing the type of the coin 3, whereas when the coin is counterfeit, the circuit 5 produces a counterfeit coin signal. The detail of the coin judging circuit 5 will be described later.

Figure 2:
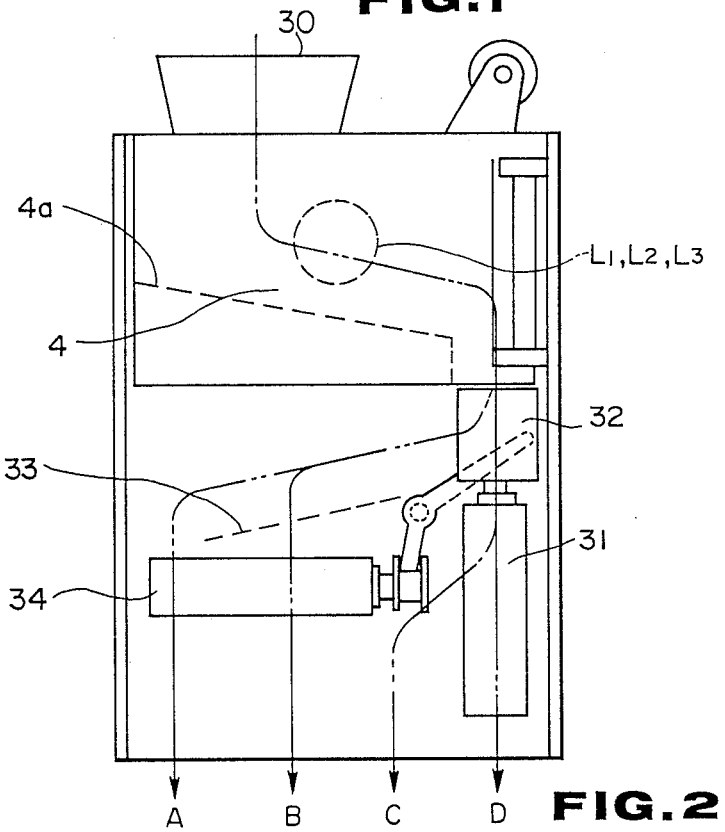
FIG. 2 is a view showing the general construction of the coin sorting apparatus according to this invention.

In FIG. 2, the coin 3 inserted into a slot 30 drops on a rail 4*a* and then passes through the coin passage 4 between the oscillation coil $L_1$ and the receiving coils $L_2$ and $L_3$ while rolling downward along the inclined rail 4*a*.

While passing through the passage 4 between coils $L_1$, $L_2$ and $L_3$, the material, thickness and the outer diameter of the coin 3 are judged by the coin judging circuit 5 and a gate 32 for separating genuine coins from counterfeit coins is controlled by a solenoid coil 31.

Thus, when the coin 3 is counterfeit, the solenoid coil 31 is energized by the counterfeit coin signal outputted from the coin judging circuit 5 such that the gate 32 will guide the coin 3 to a counterfeit coin passage, not shown, whereas when the coin 3 is genuine, the gate 32 is controlled to guide the judged coin 3 onto a rail 33.

The genuine coins guided on rail 33 are classified into coins A, B, C, and D by a classifying solenoid coil 34 energized by a signal outputted by the coin judging circuit 5 and representing the type of the coins.

Although the coin sorting apparatus described above is designed to sort genuine coins of four types, the apparatus can be constructed to judge coins of any number of types.

Figure 3:
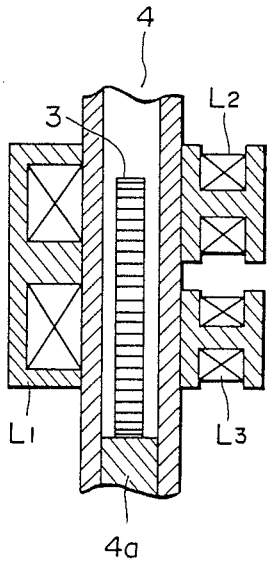
FIG. 3 shows the arrangement of the primary or oscillation coil and the receiving coil of the apparatus shown in FIG. 2.

As shown in FIG. 3, the oscillation coil $L_1$ is disposed on one side of the coin passage 4, and the receiving coils $L_2$ and $L_3$ are disposed on the opposite side to oppose the oscillation coil $L_1$.

In this embodiment, the receiving coil $L_3$ is mainly used to judge the material of the coin and the receiving coil $L_3$ is disposed near the center of the genuine coin having the smallest outer diameter.

The other receiving coil $L_2$ is mainly used to judge the outer diameter of the coin. Therefore the receiving coil $L_2$ is located near the periphery of the coin where the effect of the outer diameter of the genuine coin is significant.

Although the oscillation coil $L_1$ uses a core of pot shape, it is possible to use a drum shaped core like receiving coils $L_2$ and $L_3$.

Figure 4:
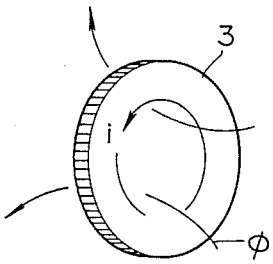
FIG. 4 is a perspective view of a coin used to explain eddy current loss.

The principle of judging the coin according to this invention will now be described. As shown in FIG. 4, when varying flux $\phi$ produced by the oscillation coil $L_1$ passes through the coin 3 made of electrically conductive material, eddy current i is induced in the coin 3. The eddy current causes an eddy current loss in the form of Joule heat due to resistance of the coin.

Denoting the rate of variation of flux $\phi$ linking the coin 3 by f and the maximum density of the flux $\phi$ by Bm, the magnitude of the electromotive force e induced in the coin 3 is expressed by $$e = \frac{\Delta\phi}{\Delta t} \propto Bm \cdot f$$

The eddy current i caused by the electromotive force e is expressed by $$i = \frac{e}{R} \propto \frac{Bm \cdot f}{R}$$

where R represents the resistance of a current path.

Consequently, the eddy current loss P can be expressed by the following equation $$P = i^2 \cdot R \propto \frac{Bm^2 \cdot f^2}{R}$$

This equation shows that the eddy current loss P is proportional to the square of the frequency of the varying flux $\phi$. Due to this eddy current loss, the flux produced by the oscillation coil is attenuated when the flux links the receiving coils. The degree of loss of flux $\phi$ caused by the eddy current loss differs dependent upon the material, that is, the specific resistance of metal used to proper coins. For example, the specific resistance at 20° C. of copper, aluminum, nickel and iron are 1.673, 2.6548, 6.84 and 9.71 microohm cm, respectively.

Figure 5:
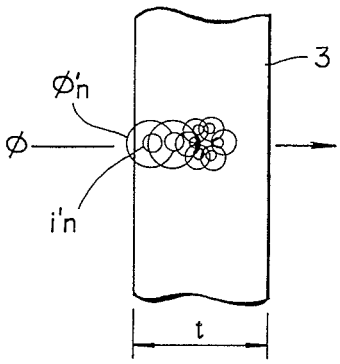
FIG. 5 is a diagram for explaining skin effect.

The eddy current causes a skin effect. FIG. 5 is an enlarged sectional view of a portion of the coin 3 and diagrammatically shows the skin effect. In FIG. 5, the eddy current produced by the flux $\phi$ flows in the direction from the front side to the reverse side. When a direct current flows in the coin 3, an electric current flows though the coin 3 uniformly with respect to the cross section thereof. When an alternating current flows in the coin 3, an electric current does not flow uniformly through the coin 3 with respect to the cross section thereof, but flows more in the surface and decreases toward the center. This phenomenon is called the skin effect.

Referring to FIG. 5, in which a cross section of the coin is divided into small segments, from electric current i'n flowing each segment, magnetic flux $\phi$'n caused by the current i'n and the number of flux linkage of $\phi$'n, it is found that the number of flux linkage is increased toward the center of the cross section of the coin. Therefore, increased electromotive force is great and the electric current is difficult to flow in the center.

This phenomenon is more conspicuous when the frequency of the applied alternative current is higher. When the frequency is very high, most of the electric current flows in the surface of the coin.

On the other hand, there is magnetic shielding effect. When a coin of magnetic substance, such as iron, passes between the oscillation coil $L_1$ and the receiving coils $L_2$ and $L_3$, the magnetic flux produced by the oscillation coil $L_1$ is absorbed in the coin, and the receiving coils $L_2$ and $L_3$ receive reduce flux.

It is known that the skin effect and the magnetic shielding effect generated simultaneously.

This invention is based on a unique utilization of this phenomenon. More particularly, the oscillation coil $L_1$ is excited by a rectangular wave consisting of a fundamental wave and a plurality of harmonic waves and the judgment of the coin is made by utilizing these harmonic waves.

Figure 6:
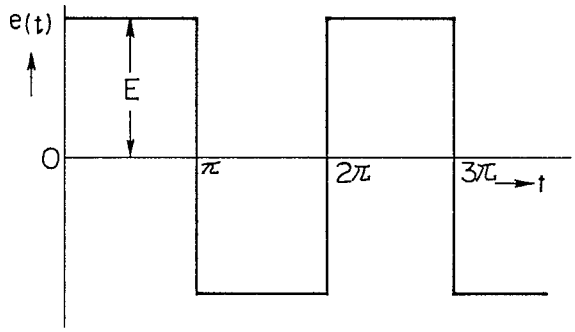
FIG. 6 shows one example of a rectangular wave.
Figure 7:
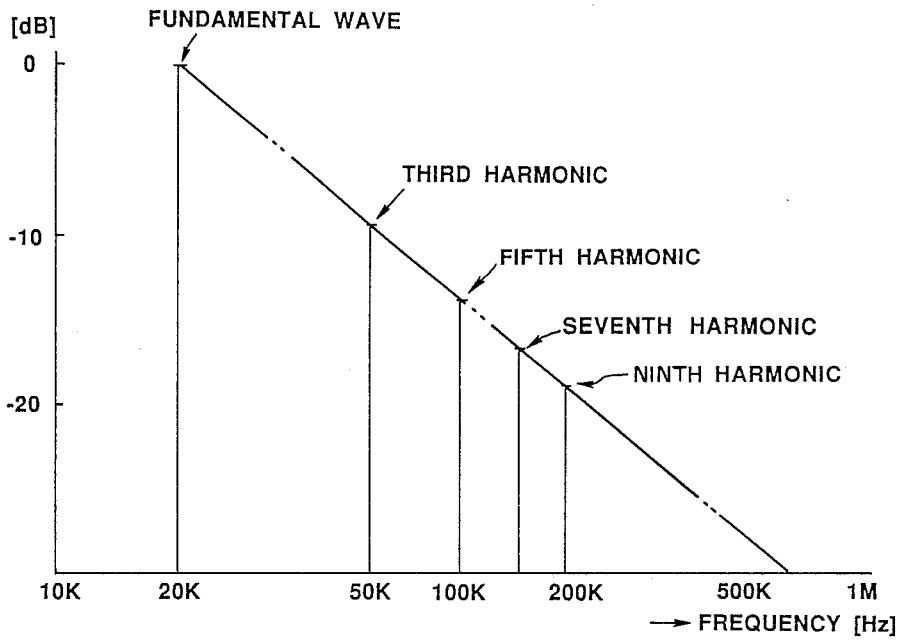
FIG. 7 is a spectrum diagram showing the harmonic components of the rectangular wave.

FIG. 7 is a frequency spectrum showing theoretical magnitudes of various harmonic components contained in a rectangular wave shown in FIG. 6 also containing a fundamental wave having a frequency of 20 kHz.

In addition to a rectangular wave pulse, such nonsinusoidal waves as a triangular wave and a saw tooth wave also contain many harmonic components.

Figure 8:
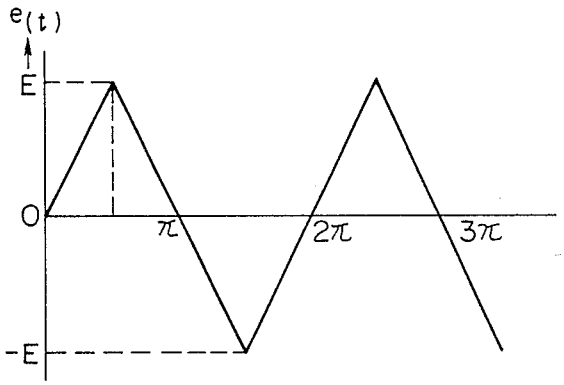
FIG. 8 shows one example of a triangular wave.
Figure 9:
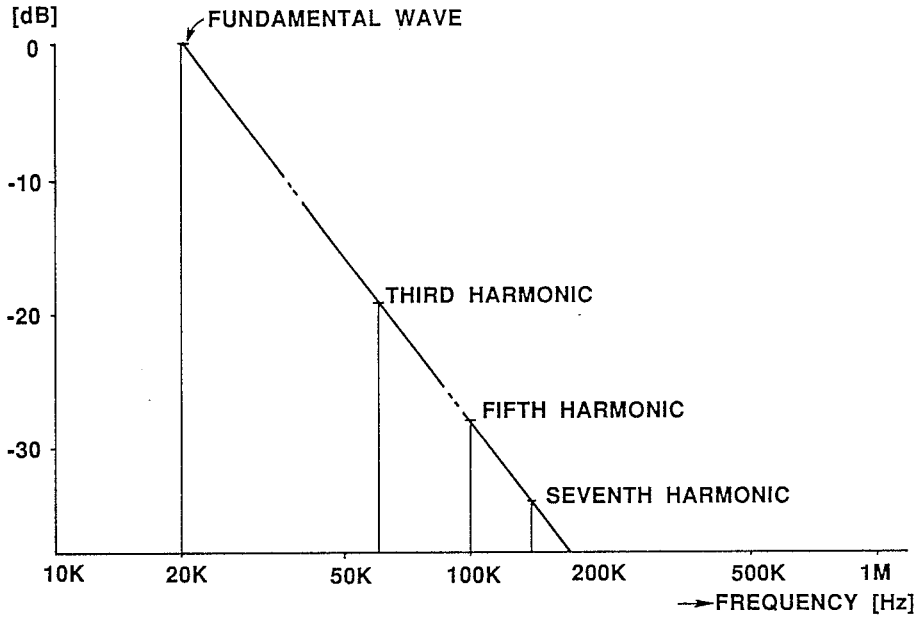
FIG. 9 is a spectrum diagram showing the harmonic components of the triangular wave shown in FIG. 8.
Figure 10:
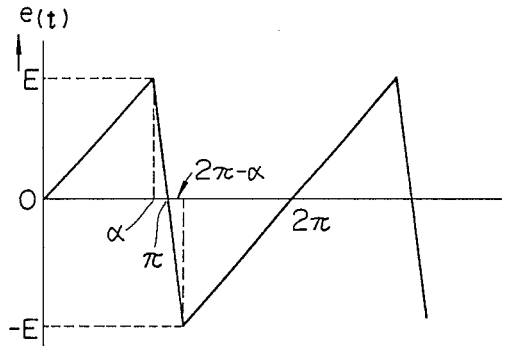
FIG. 10 shows one example of a saw tooth wave.

FIG. 9 is a frequency spectrum showing theoretical magnitudes of components contained in a triangular wave shown in FIG. 8 and having a fundamental wave having a frequency of 20 kHz. In the same manner, FIG. 11 shows a frequency spectrum of a saw tooth wave shown in FIG. 10.

The harmonic components of the rectangular wave, the triangular wave and the saw tooth wave which are not sinusoidal can be explained by Fourier series.

Figure 11:
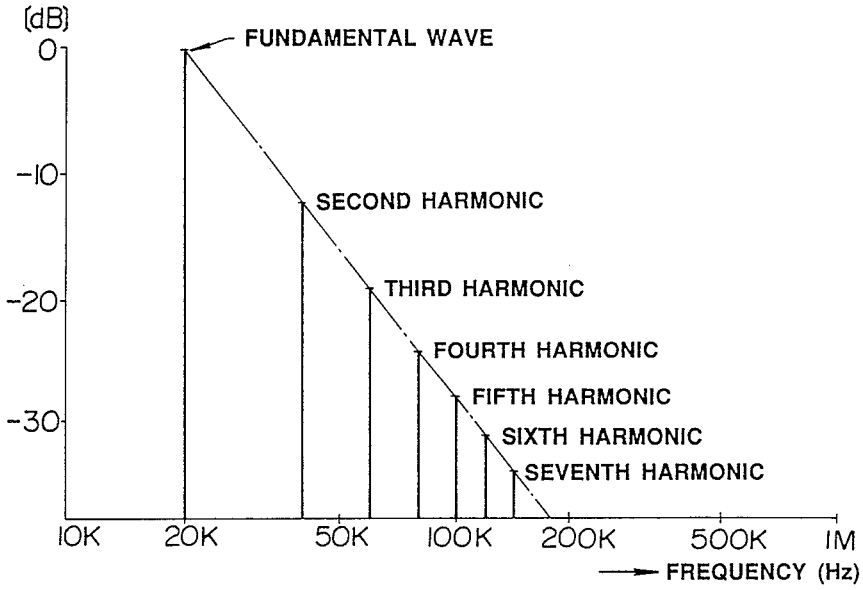
FIG. 11 is a spectrum diagram showing the harmonic components of the saw tooth wave shown in FIG. 10.

Comparing FIGS. 7, 9 and 11 with each other, the maximum value of the harmonic waves contained in a nonsinusoidal alternating current decreases as the order of the harmonic becomes higher but the rate of attenuation is great as the degree of discontinuation of the waveform is small. The waveform useful to this invention is one whose degree of discontinuation is large. Accordingly, a comparison of FIGS. 7, 9 and 11 shows that a rectangular wave shown in FIG. 6 is most effective.

Figure 12:
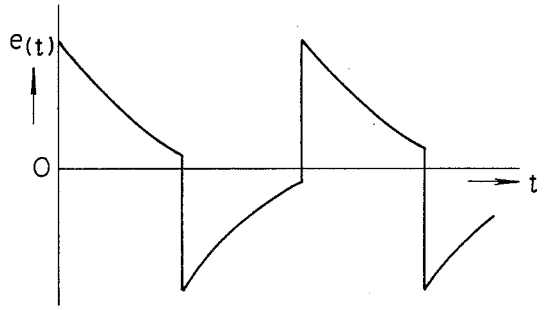
FIG. 12 shows the waveform of a voltage impressed across the oscillation coil utilized in this embodiment.
Figure 13:
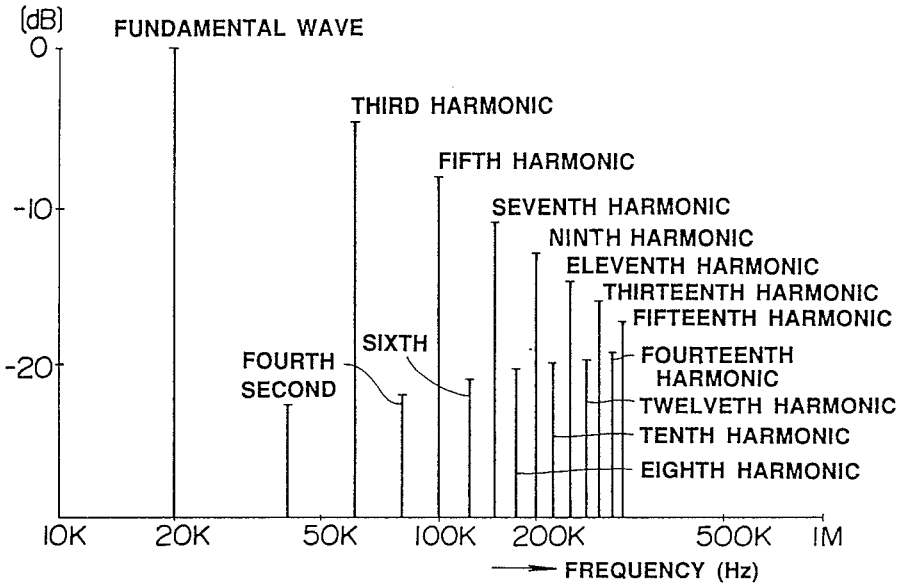
FIG. 13 is a spectrum diagram showing the harmonic components of the voltage shown in FIG. 12.

From experiment, it was found that with the configuration shown in FIG. 1, the voltage waveform across the oscillation coil $L_1$ is the waveform shown in FIG. 12. The frequency spectrum of the voltage induced in the receiving coils $L_2$ and $L_3$ is shown in FIG. 13 which contains harmonic components useful to this invention.

Figure 14:
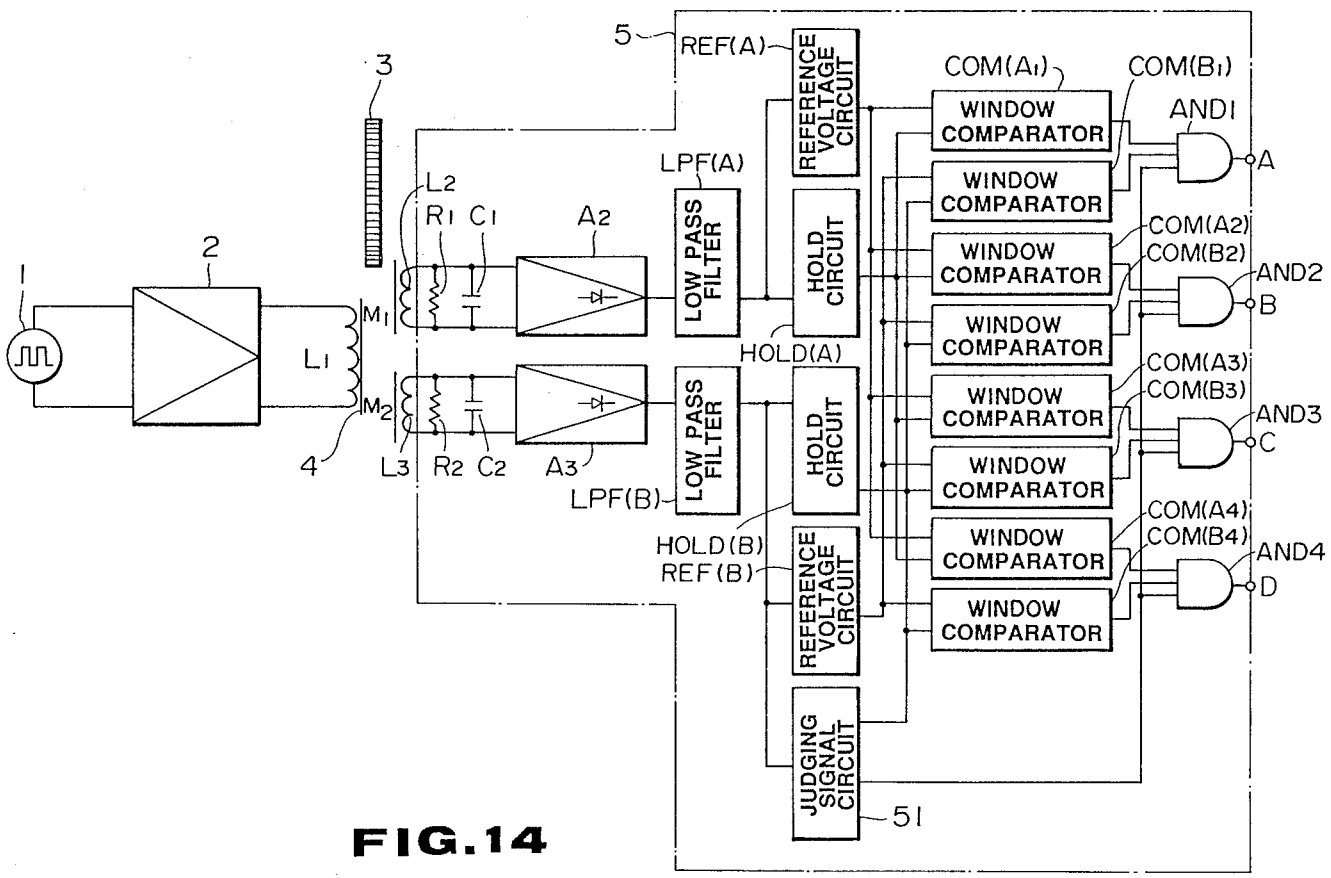
FIG. 14 is a block diagram showing a detail of this embodiment.

FIG. 14 shows the detail of the configuration of the embodiment shown in FIG. 1. In FIG. 14, a resonance circuit constituted by a resistor $R_1$ and a capacitor $C_1$ is connected across the receiving coil $L_2$ and a similar resonance circuit including a resistor $R_2$ and a capacitor $C_2$ is connected across the receiving coil $L_3$.

Figure 15:
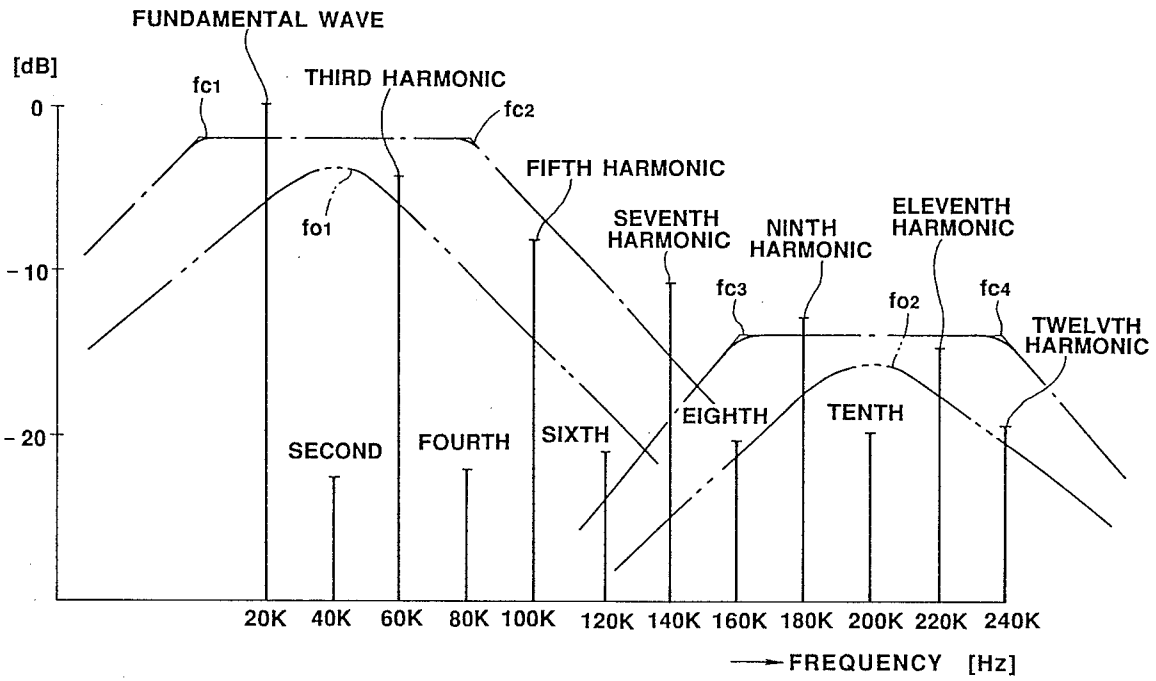
FIG. 15 is a spectrum diagram used to explain the operation of the circuits shown in FIG. 14.

These resonance circuits have filter effects having resonance points $f_{01}$ and $f_{02}$ shown in FIG. 15. As shown in FIG. 15, the resonance point $f_{01}$ is located between the fundamental frequency 20 kHz and the third harmonic 60 kHz and effective composite compositions corresponding to respective frequencies are derived out. The resonance point of frequency $f_{02}$ is located between the frequencies of 9th harmonic 180 kHz and the 11th harmonic 220 kHz so that effective composite components corresponding to respective frequencies are derived out. The composite composition corresponding to the frequency $f_{01}$ is used to examine or judge the material and thickness of the coin to be judged, whereas the composite component corresponding to the frequency $f_{02}$ is used to judge the outer diameter of the coin. When the coin 3 passes through the coin passage between the coils $L_1$, $L_2$ and $L_3$ the resultant wave form appearing across receiving coils $L_2$ and $L_3$ is as shown in FIG. 16.

Figure 16:
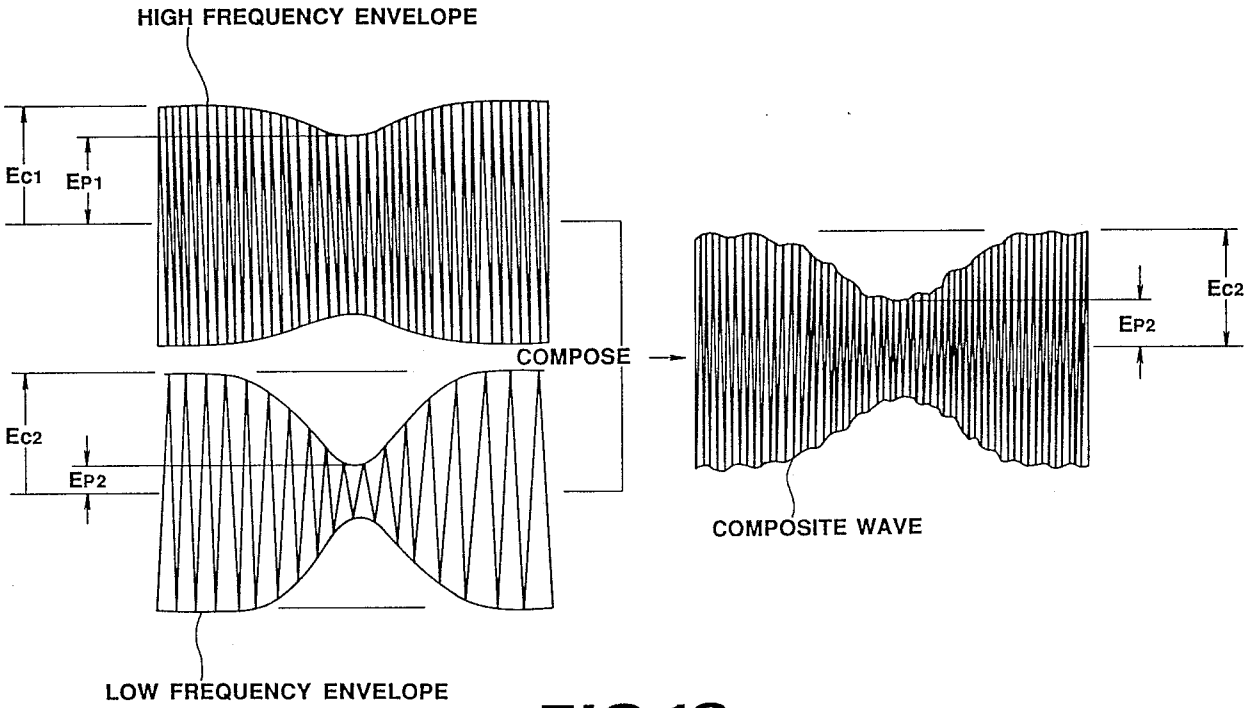
FIG. 16, 17 and 18 are waveforms used to explain the operation of the circuits shown in FIG. 14.

By the action of the resonance circuit $R_1$, $C_1$, a composite wave as shown in FIG. 16, which is a resultant of the fundamental wave (low frequency) and the third harmonic (high frequency), appears across the receiving coil $L_2$. In the same manner, a composite wave corresponding to the resultant of the 9th and 11th harmonics appears across the receiving coil $L_3$.

Figure 17:
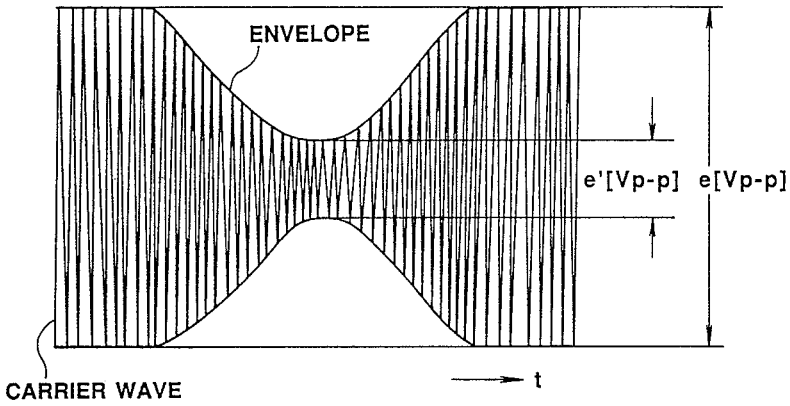
Figure 18:
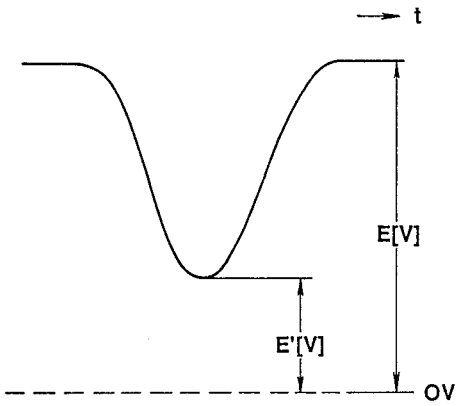

Composite waves appearing across the receiving coils $L_2$ and $L_3$ by the actions of the resonant circuits $R_1$, $C_1$ and $R_2$, $C_2$ are applied to low pass filters LPF(A) and LPF(B) respectively via amplifiers $A_2$ and $A_3$. Each of the signals passed through the low pass filters is an envelop signal shown in FIG. 18 obtained by demodulating (that is by removing carrier wave) modulated wave shown in FIG. 17. After passing through the low pass filters LPF(A) and LPF(B), the signals are temporary stored in hold circuits HOLD(A) and HOLD(B) and then applied to comparators COM ($A_1$–$A_4$) and COM ($B_1$–$B_4$) respectively set with threshold values of respective coins produced by reference voltage circuits REF(A) and REF(B). When the coin 3 is judged as genuine, a comparator corresponding to this coin produces a signal which is applied to one input of one of AND gate circuits AND(1–4), the other input being supplied with a gate signal outputted from a judging signal circuit 51. AND gate circuits AND(1–4) produce genuine coin signals A, B, C and D. These signals control the genuine and counterfeit sorting solenoid coil 31 through a suitable control unit, for example, a central processing unit, so as to guide a genuine coin to the genuine coin passage.

As above described in accordance with this embodiment, a single oscillation coil $L_1$ is excited by a nonsinusoidal alternating current generated by the rectangular wave oscillation circuit 1. The oscillation coil $L_1$ is coupled with two receiving coils $L_2$ and $L_3$, resonance frequencies thereof being selected to suitable frequencies by resonance circuits $R_1$, $C_1$ and $R_2$, $C_2$, and the coin is judged by the output voltages of the receiving coils $L_2$ and $L_3$. Thus it is possible to judge the material, thickness and outer diameter of the coin 3 by using only one oscillation circuit and a single oscillation coil.

Figure 19:
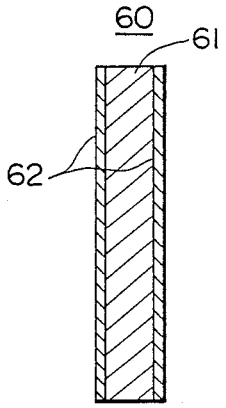
FIG. 19 is a vertical sectional view of a coin that can be judged according to this invention.
Figure 21:
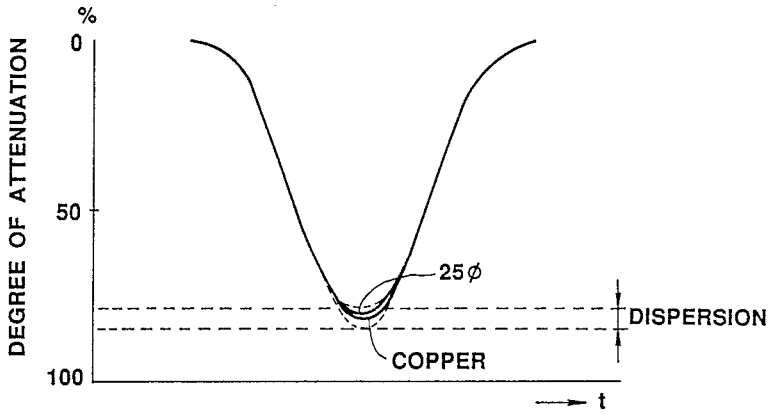

When prior art apparatus utilizing a single frequency is used to judge US 5c, 10c and 25c coins, each comprising a core of copper and outer layers of nickel as shown in FIG. 19 (that is so-called a clad coin), and a coin made of copper only, the characteristic of copper appears as shown in FIG. 21 thus failing to discriminate mere copper coins from clad coins.

Figure 22:
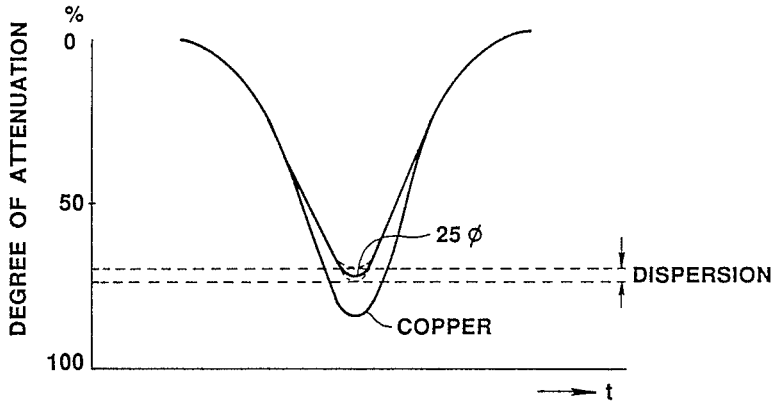

With the apparatus of this invention, the judged characteristics of the coins are shown by the curves in FIG. 22. Thus the difference between two curves becomes larger than that shown in FIG. 21 which makes accurate judging.

Figure 20:
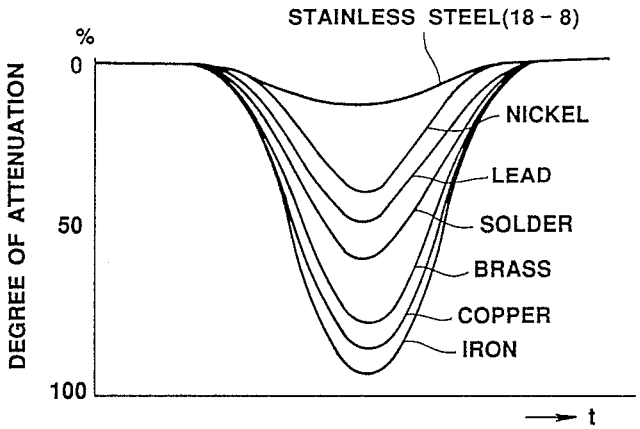
FIG. 20, 21 and 22 are graphs showing the effect of judgment.

More particularly, a clad coin 60 comprising a core 61 made of copper and nickel clads 62 and a copper coin having the same diameter and thickness as the clad coin 60 are taken as examples. Suppose now that the frequency of the fundamental wave is set in a range of 15–30 kHz and that the frequencies of the harmonic waves are set in a range of 45–90 kHz. Then in the low frequency range of 15–30 kHz, the flux mainly interacts with the copper comprising the core of the clad coin and the percentage of attenuation resembles a curve of copper shown in FIG. 20. However, the harmonic waves result in a skin effect. By the resultant function of these effects identification of a clad coin and a copper coin can be made readily as shown in FIG. 22. As the frequency of the AC exciting field generated by the oscillation coil $L_1$ increases, the skin effect caused by the eddy current loss becomes remarkable. In the case of a coin as shown in FIG. 19, the skin effect concentrates in the clads, which is different from that appearing in the surface of copper. As a consequence the copper coin can be discriminated from the clad coin as shown in FIG. 22.

Figure 23:
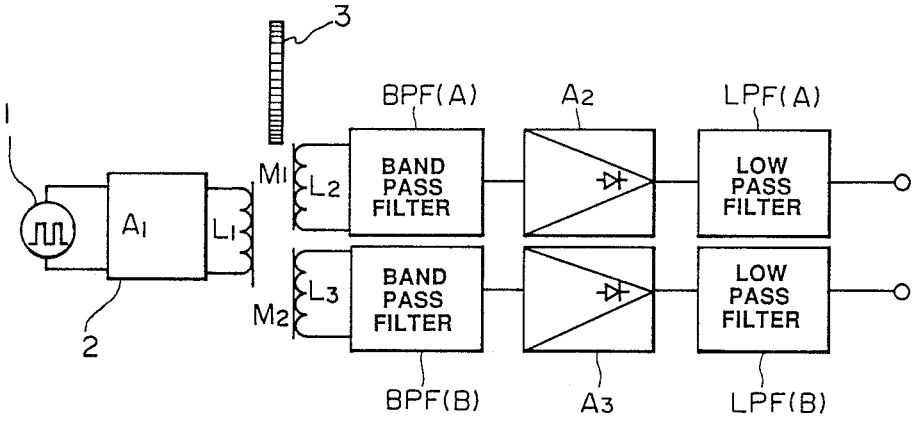
FIG. 23 is a block diagram showing another embodiment of this invention.
Figure 24:
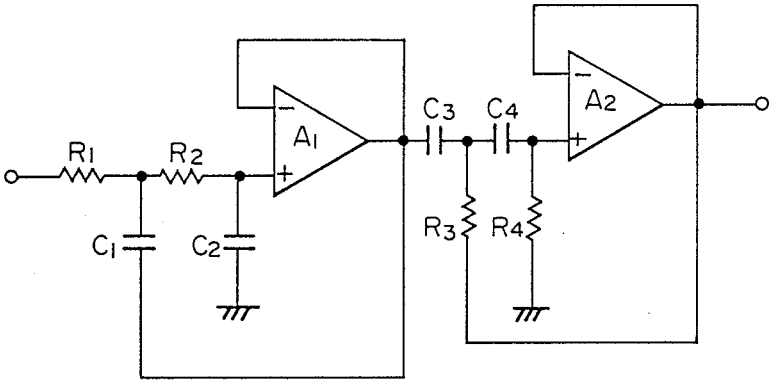
FIG. 24 is a block diagram showing one example of a bandpass filter utilized in the embodiment shown in FIG. 23.

Another embodiment of this invention is shown in FIG. 23. In this embodiment, oscillation coil $L_1$ is excited by a rectangular wave oscillation circuit 1, and receiving coils $L_2$ and $L_3$ are connected to bandpass filters BPF(A) and BPF(B), respectively, constructed to pass frequencies $f_{c1}$, $f_{c2}$ and $f_{c3}$, $f_{c4}$ shown in FIG. 15. The bandpass filters BPF(A) and BPF(B) can be constructed in accordance with the bandpass filter circuitry of FIG. 24. Signals outputted from these filters BPF(A) and BPF(B) have waveforms as shown in FIG. 16, from which a composite wave can be derived out. As above described, this modification operates in the same manner as the embodiments shown in FIGS. 1 and 14.

Figure 25:
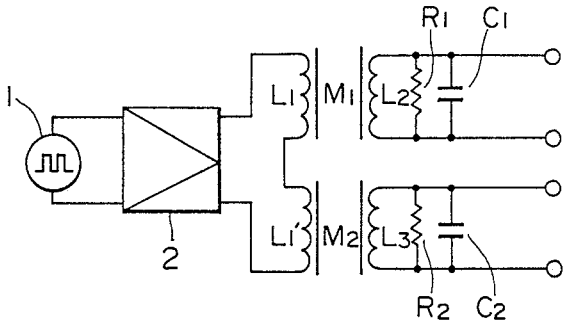
FIG. 25 is a block diagram showing still another embodiment of this invention.

FIG. 25 shows still another embodiment of this invention in which two oscillation coils $L_1$ and $L_1'$ are excited by the same nonsinusoidal alternating current. As shown, oscillation coils $L_1$ and $L_1'$ are connected in series to be excited by the output of the rectangular wave oscillation circuit 1 via an amplifier 2. Receiving coils $L_2$ and $L_3$ are provided to couple with the oscillation coils $L_1$ and $L_1'$ respectively.

Receiving coils $L_2$ and $L_3$ and capacitors $C_1$ and $C_2$ form resonance circuits and provide filter effects having resonance points $f_{01}$ and $f_{02}$ shown in FIG. 15 in the same manner as in the embodiment shown in FIG. 14. As a consequence signals produced by the receiving coils $L_2$ and $L_3$ are composed as shown in FIG. 16, meaning that the modification shown in FIG. 25 operates in the same manner as the embodiment shown in FIGS. 1 and 14.

Figure 26:
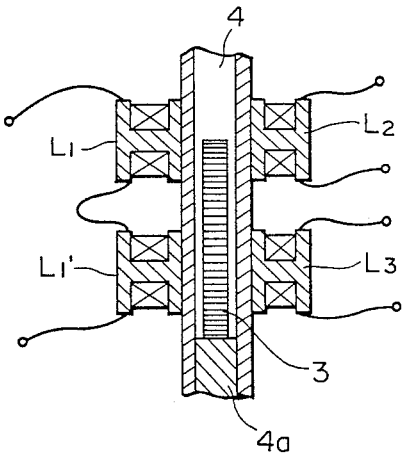
FIG. 26 is a vertical sectional view showing one example of the coil arrangement of the embodiment shown in FIG. 25.

An actual construction of the oscillation coils $L_1$ and $L_1'$, the receiving coils $L_2$ and $L_3$ and the coin passage 4 are shown in FIG. 26.

Figure 27:
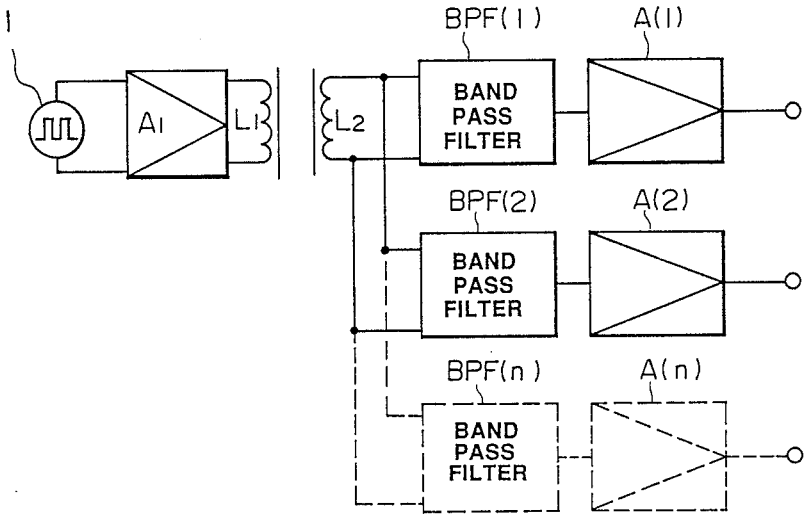
FIG. 27 is a block diagram showing yet another embodiment of this invention.
Figure 28:
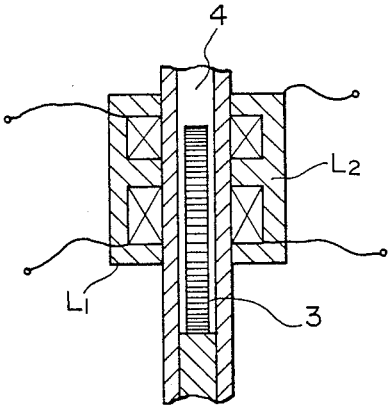
FIG. 28 is a vertical sectional view showing one example of the coil arrangement of the embodiment shown in FIG. 27.

Still another embodiment shown in FIGS. 27 is constituted by a single oscillation coil $L_1$ and an opposing single receiving coil $L_2$. As shown in FIG. 27, a plurality of bandpass filters BPF(1−n) are connected to the receiving coil $L_2$ and the outputs of the bandpass filters BPF(1−n) are derived out through amplifiers A(1−n) respectively. The arrangement of the oscillation coil $L_1$, the receiving coil $L_2$ and the coin passage 4 are shown in FIG. 28.

In the foregoing embodiments a rectangular wave oscillator is used to excite one or more primary coils, but nonsinusoidal waves other than the rectangular wave can be used so long as the nonsinusoidal wave contains desired harmonics of sufficient levels.

It should be understood that the invention is not limited to specific embodiments described above, and that many changes and modification can be made within the true spirit and scope of the invention as defined in the appended claims.

What is claimed is:

1. A method of sorting coins comprising the steps of:

passing a coin to be sorted near an oscillation coil excited by an exciting signal containing a plurality of harmonic components;

generating a received signal in a receiving coil electromagnetically coupled with said oscillation coil;

deriving out from said received signal at least two signals with each deriving signal containing a different harmonic component;

judging whether the coins are genuine or counterfeit and type of said coins based on said deriving signals; and sorting said coins in accordance with the performance of said judging step.

2. The method according to claim 1 wherein each deriving signal is a composite signal of at least two harmonic components.

3. The method according to claim 1 wherein each deriving signal comprises a first received signal corresponding to a composite signal of at least two harmonic components and a second received signal corresponding to a composite signal of at least two other harmonic components.

4. A method of sorting coins comprising the steps of:

passing a coin near an oscillation coil excited by a nonsinusoidal alternating current;

generating a received signal in a receiving coil electromagnetically coupled with said oscillation coil;

deriving out from said received signal a first signal corresponding to a composite signal of at least two harmonic components, and a second signal corresponding to a composite signal of at least two other harmonic components;

judging whether the coins are genuine or counterfeit and type of said coins based on said first and second signals; and sorting said coins in accordance with the performance of said judging step.

5. The method according to claim 4 wherein said first signal is a composite signal of a fundamental wave component and a second harmonic component, said second signal is a composite signal of an nth harmonic component and an (N+1) th harmonic component adjacent to said nth harmonic component, and n is greater than 2.

6. A coin sorting apparatus comprising:

an oscillation coil excited by an exciting signal containing a plurality of harmonic components;

a receiving coil electromagnetically coupled with said oscillation coil;

a coin passage for passing said coin near said oscillation coil, means for extracting a signal based on at least two harmonic components from a received signal generated in said receiving coil as a result of passing said coin through said coin passage; and means for sorting said coin based on said signal extracted by said extracting means.

7. The coin sorting apparatus according to claim 6 wherein said extracting means comprises a resonance circuit resonating to a signal in a specific frequency bandwidth.

8. The coin sorting apparatus according to claim 6 wherein said extracting means comprises a bandpass filter selectively passing a signal in a specific frequency bandwidth.

9. The coin sorting apparatus according to claim 6 wherein said extracting means comprises means for simultaneously extracting at least two harmonic components and means for combining said extracted harmonic components for producing a signal utilized to judge said coins.

10. A coin sorting apparatus comprising:

a coin passage;

an oscillation coil disposed on one side of said coin passage and excited by a nonsinusoidal alternating current;

first and second receiving coils disposed on the other side of said coin passage and electromagnetically coupled with said oscillation coil;

first extracting means connected to said first receiving coil for simultaneously extracting at least two harmonic components from a signal received by said first receiving coil to produce a composite signal of said at least two extracted harmonic components;

second extracting means connected to said second receiving coil for simultaneously extracting at least two other harmonic components from a signal received by said second receiving coil to produce a composite signal of said at least two other extracted harmonic components;

judging means responsive to output signals of said first and second extracting means for judging whether the coins are genuine or counterfeit and type of said coins passing through said coin passage, and sorting means for sorting said coins passing through said coin passage in accordance with an output of said judging means.

11. A coin sorting apparatus comprising:

a coin passage;

first and second oscillation coils disposed on one side of said coin passage and excited by the same nonsinusoidal alternating current;

first and second receiving coils which are electromagnetically coupled with said first and second oscillation coils respectively;

first extracting means connected to said first receiving coil for simultaneously extracting at least two harmonic components from a signal received by said first receiving coil to produce a composite signal of said at least two harmonic components;

second extracting means connected to said second receiving coil for simultaneously extracting at least two other harmonic components from a signal received by said second receiving coil to produce a composite signal of said at least two other harmonic components;

judging means responsive to output signals of said first and second extracting means for judging whether the coins are genuine or counterfeit and type of said coins passing through said coin passage, and sorting means responsive to an output signal of said judging means for sorting said coins passing through said coin passage.

12. A coin sorting apparatus comprising:

a coin passage;

a single oscillation coil disposed on one side of said coin passage and excited by a nonsinusoidal alternating current;

a single receiving coil disposed on the other side of said coin passage and electromagnetically coupled with said oscillation coil;

extracting means connected to said receiving coil for deriving out a composite signal of at least two harmonic components;

judging means responsive to an output signal of said extracting means for judging whether coins are genuine or counterfeit and type of said coins passing through said coin passage; and sorting means responsive to an output signal of said judging means for sorting said coins passing through said coin passage.

* * * * *